United States Patent [19]

Kremer et al.

[11] 4,358,038

[45] Nov. 9, 1982

[54] PUNCH FOR PATTERN CARD

[75] Inventors: Hubert Kremer, Grefrath; Josef Claassen, Goch, both of Fed. Rep. of Germany

[73] Assignee: Maschinenfabrik Carl Zangs Aktiengesellschaft, Krefeld, Fed. Rep. of Germany

[21] Appl. No.: 186,042

[22] Filed: Sep. 11, 1980

[30] Foreign Application Priority Data

Sep. 27, 1979 [DE] Fed. Rep. of Germany ..... 2939123

[51] Int. Cl.[3] ..... G65H 17/38; G03B 1/30

[52] U.S. Cl. ..... 226/53; 226/74

[58] Field of Search ..... 226/53, 54, 55, 170, 226/171, 74, 76; 83/218

[56] References Cited

U.S. PATENT DOCUMENTS

| | | | |
|---|---|---|---|
| 1,763,735 | 6/1930 | Wydom | 226/53 |
| 3,160,340 | 12/1964 | Menkel | 226/53 |
| 3,368,727 | 2/1968 | Sutton | 226/74 |
| 3,825,162 | 7/1974 | Hubbard | 226/74 |
| 4,088,256 | 5/1978 | Potma | 226/74 |
| 4,197,799 | 4/1980 | Sato | 226/53 |

*Primary Examiner*—Edward J. McCarthy
*Attorney, Agent, or Firm*—Martin A. Farber

[57] ABSTRACT

A punch for a pattern card for textile machines, for instance shedding machines or automatic knitting machines, having a step-by-step transport device and a centering device for pin wheels arranged on a shaft, for the transport of the pattern card. In order to increase the punching output and reduce the noise level, the step-by-step transport device comprises a stepping motor, and a coupling is arranged between the stepping motor and the shaft, and a centering wheel, which cooperates with a lever which simultaneously actuates the coupling, is fastened on the shaft.

6 Claims, 2 Drawing Figures

PUNCH FOR PATTERN CARD

The present invention relates to a punch device for a pattern card for textile machines, particularly shedding machines or automatic knitting machines, having a step-by-step transport device and a centering device for pin wheels arranged on a shaft, for the transport of the pattern card.

In weaving and knitting mills, data carriers are used for the production of pictorial presentations. These data carriers comprise endless pattern cards having transport holes arranged on their edges for pin wheels arranged on the shaft and, in between them, data arranged at equal distances apart in the form of a pattern of holes which is sensed by the textile machine and converted into a corresponding weaving or knitting pattern. The pattern cards are produced in studios, the artistic designs of which since recently have been scanned by optical-electronic means, then processed in a computer into electric signals and finally converted by the punch into mechanical pulses and punched in the form of holes into the pattern card. At times the pattern cards must be repeatedly conducted in synchronized steps through the punch in order to receive further information.

In the known punch devices, the pin wheels for transporting the pattern card are driven by a step-by-step transport mechanism constructed in accordance with the principle of a ratchet transport. Since the distances between punchings in the pattern card may differ, for instance in the case of a shedding machine between the information for the individual filling yarns, a ratchet wheel is arranged on the pin wheels, the ratchet wheel taking this difference in the distances between the punchings into consideration. The pawl of the known step-by-step transport mechanism which acts with high speed on the teeth of the ratchet wheel not only causes a high noise level, but also regularly carries out a small excess stroke which is at least so large that transport is always effected by the maximum distance between punchings. The excess stroke must be corrected by a blocking tooth which brings the pin wheel to a standstill for the punching. This known step-by-step transport mechanism permits only a limited punching output.

Proceeding from this background, the object of the present invention is to create a punch device by which the punching output can be increased and at the same time the noise level produced upon the punching can be reduced.

This object is achieved with a punching device of the type described above in the manner that the step transport device comprises a known per se electric stepping motor, that a clutch or coupling is arranged between the stepping motor and the shaft, and that a centering wheel, which cooperates with a lever which simultaneously actuates the clutch, is fastened on the shaft.

In one practical embodiment, a reduction gearing, comprising preferably two toothed belt drives, can be arranged between the stepping motor and the shaft for the transport of the pattern card, said gearing having a stepdown ratio of about 1:10. In this way it is possible to reduce the high stepping speed of the electrical stepping motor to such an extent that the transport holes on the pattern card are not damaged by the pin wheels.

In a further development of the invention it has been found advisable to use as the coupling between the stepping motor and the shaft an electromagnetic clutch which can be disengaged via a limit switch which is actuated by the lever.

A punching device developed in accordance with the invention not only has the advantage that the noise level caused up to now by the known transport mechanisms has been practically completely eliminated, but it also makes possible an increased punching output, this output being limited in practice only by the resistance of the transport edges of the pattern card. Furthermore, the use of an electric stepping motor also has the advantage that the distance between punchings can be bridged over by a plurality of stepping motor steps so that even different distances between punchings in a pattern card or punching spacings which are not divisible by the pregiven smallest existing step length can be carried out with negligibly small errors.

Further details, features and advantages of the object of the invention will become evident from the following description of the accompanying drawing in which a punching device developed in accordance with the invention has been shown diagrammatically in a side view and a cross section.

Figure 1:
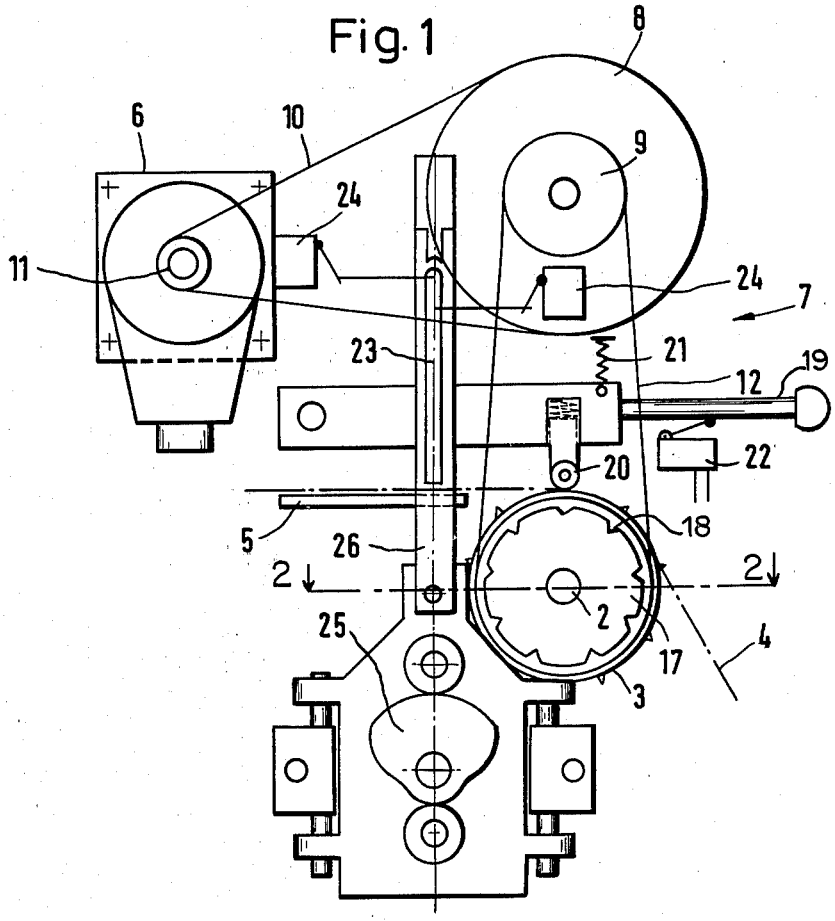
FIG. 1 shows the essential parts of a punching device in side view.
Figure 2:
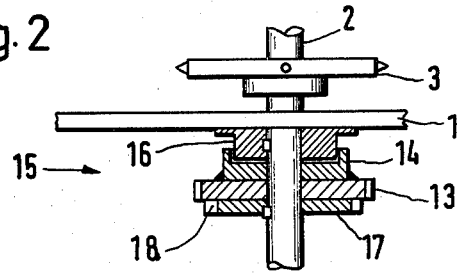
FIG. 2 shows a section, taken along the lines 2—2 in FIG. 1 through the shaft for the transport of the pattern card on one side of the punch device, seen in top view.

On a shaft 2 which is mounted in the machine frame 1 there are fastened, spaced apart from each other, two pin wheels 3 which pull a pattern card 4 step-by-step over a punch table 5. As a drive for the shaft 2 and pin wheels 3 there is provided an electric stepping motor 6. Between the stepping motor 6 and the shaft 2 there is interposed a stepdown transmission 7 which comprises of two toothed-belt drives 8 and 9. A first toothed belt 10 takes up the moment of rotation from a pinion 11 of the stepping motor 6, while a second toothed belt 12 transmits it to a gear wheel 13 mounted on the shaft 2.

An outer disk 14 of an electromagnetic clutch or coupling 15 is rigidly connected with the gear wheel 13, while its inner disk 16 is fastened firmly to the shaft 2 so as to rotate with it. With the electromagnetic clutch 15 it is therefore possible to interrupt the drive line extending from the stepping motor 6 via the stepdown transmission 7 to the shaft 2.

In front of the gear wheel 13 a centering wheel 17 with recesses 18 is fastened on the shaft 2. The centering wheel 17 cooperates with a lever 19 which has a resiliently mounted centering roller 20 and can be pivoted against the action of a tension spring 21 in the direction towards the shaft 2. In the region of movement of the lever 19 there is arranged a limit switch 22 which can interrupt the excitation current of the electromagnetic clutch 15 and thus disengage the clutch.

Above the punch table 5 there are arranged in a plane, one behind the other, a plurality of punches 23 which can be moved by means of control magnets 24 into the path of movement of a piston 26 which is driven by a cam 25.

A punch developed in accordance with the invention operates as follows:

First of all, the electric system is turned on.

After the insertion of the pattern card 4, the shaft 2 must first of all be adjusted with reference to the zero position of the stepping motor 6. For this purpose, the lever 19 is depressed and in this way the electromagnetic clutch 15 opened so that the centering roller 20, by engagement into a recess 18 of the centering wheel 17, can turn and displace, respectively, the shaft 2 and therewith at the same time also the pin wheels 3 and the pattern card 4, respectively, into the zero position. Upon release of the lever 19, the electromagnetic clutch 15 is again energized so that the shaft 2 is connected in slip-free manner via the stepdown transmission 7 with the stepping motor 6. Thereupon the stepping motor 6 and the punches can be placed in operation. The manner of connection of the stepping motor 6 with the drive for the punches and the control of the punch tools 23 does not form the subject matter of the invention and is therefore also not shown or described in detail.

We claim:

1. In a punching device for a pattern card for textile machines, having a step-by-step transport device and a centering device for pin wheels arranged on a shaft for the transport of the pattern card, the improvement wherein said step-by-step transport device comprises a stepping motor, a coupling operatively disposed between the stepping motor and the shaft, a centering wheel fastened on said shaft, a lever means for cooperating with said centering wheel and for simultaneously actuating said coupling.

2. The punching device according to claim 1, further comprising a stepdown transmission is arranged between the stepping motor and the shaft.

3. The punching device according to claim 1, wherein the stepdown ratio between the stepping motor and the shaft is about 1:10.

4. The punching device according to claim 1, wherein said coupling is an electromagnetic clutch, a limit switch means for disengaging said electromagnetic clutch, said lever means for actuating said limit switch means.

5. The punching device according to claim 1, wherein said stepdown transmission comprises two toothed-belt drives.

6. The punching device according to claim 1, wherein said centering wheel is formed with a plurality of peripheral recesses, a spring-biased roller mounted on said lever means and engaging in said recesses upon actuation of said lever means so as to disengage said coupling.

* * * * *

UNITED STATES PATENT AND TRADEMARK OFFICE

CERTIFICATE OF CORRECTION

PATENT NO. : 4,358,038

DATED : November 9, 1982

INVENTOR(S) : Hubert Kremer, et al

It is certified that error appears in the above-identified patent and that said Letters Patent are hereby corrected as shown below:

Column 4, Claim 3, Line 8, "1" should read --2--

Signed and Sealed this

*Eighth* Day of *February 1983*

[SEAL]

*Attest:*

GERALD J. MOSSINGHOFF

*Attesting Officer*

*Commissioner of Patents and Trademarks*